United States Patent [19]

Horton

[11] Patent Number: 4,740,109

[45] Date of Patent: Apr. 26, 1988

[54] MULTIPLE TENDON COMPLIANT TOWER CONSTRUCTION

[76] Inventor: Edward E. Horton, 85 Vanderlip Dr., Portugese Bend, Calif. 90274

[21] Appl. No.: 779,500

[22] Filed: Sep. 24, 1985

[51] Int. Cl.[4] ..... E21B 7/12; F16L 37/08

[52] U.S. Cl. ..... 405/224; 114/265; 405/195; 405/202

[58] Field of Search ..... 405/195, 224, 202; 114/265

[56] References Cited

U.S. PATENT DOCUMENTS

| | | | |
|---|---|---|---|
| 3,982,401 | 9/1976 | Loggins | 405/224 |
| 4,182,584 | 1/1980 | Panicker et al. | 405/195 |
| 4,212,561 | 7/1980 | Wipkink | 405/195 |
| 4,234,270 | 11/1980 | Gjerde et al. | 405/202 |
| 4,273,470 | 6/1981 | Blomsma et al. | 405/202 |
| 4,363,567 | 12/1982 | VanderGraaf | 405/195 |
| 4,398,846 | 8/1983 | Agdern | 405/195 X |
| 4,423,984 | 1/1984 | Panicker et al. | 405/195 |
| 4,462,717 | 7/1984 | Falcimaigne | 405/195 |
| 4,511,287 | 4/1985 | Horton | 405/195 X |
| 4,662,785 | 5/1987 | Gibb et al. | 405/195 |

FOREIGN PATENT DOCUMENTS

| | | | |
|---|---|---|---|
| 7605895 | 12/1977 | Netherlands | 405/224 |
| 2139677 | 11/1984 | United Kingdom | 405/202 |

*Primary Examiner*—Dennis L. Taylor

*Attorney, Agent, or Firm*—Poms, Smith, Lande & Rose

[57] ABSTRACT

An offshore multiple tendon compliant buoyant tower construction for well operations in which a plurality of tendons are arranged in parallel, vertical, closely spaced assembled relation and have top and bottom ends, the bottom ends being connected to a base module at the sea floor, the top ends being connected to a buoyant structure which includes conductor tubes therein for each of said tendons and which serves to restrict bending of the top portion of said tendons to provide a relatively stiff, unbending, noncompliant tendon top portion which extends below the sea surface, the portion of the assembled tendons below the stiff to portion being relatively compliant; the buoyant structure imparting tension to said plurality of assembled tendons at the top ends thereof whereby the tensioned tendons provide lowering of the effective center of gravity of the tower construction below the center of buoyancy and whereby cyclic stresses in the assembled tendons resulting from roll or bending of the tower construction is reduced.

22 Claims, 9 Drawing Sheets

Fig. 14.
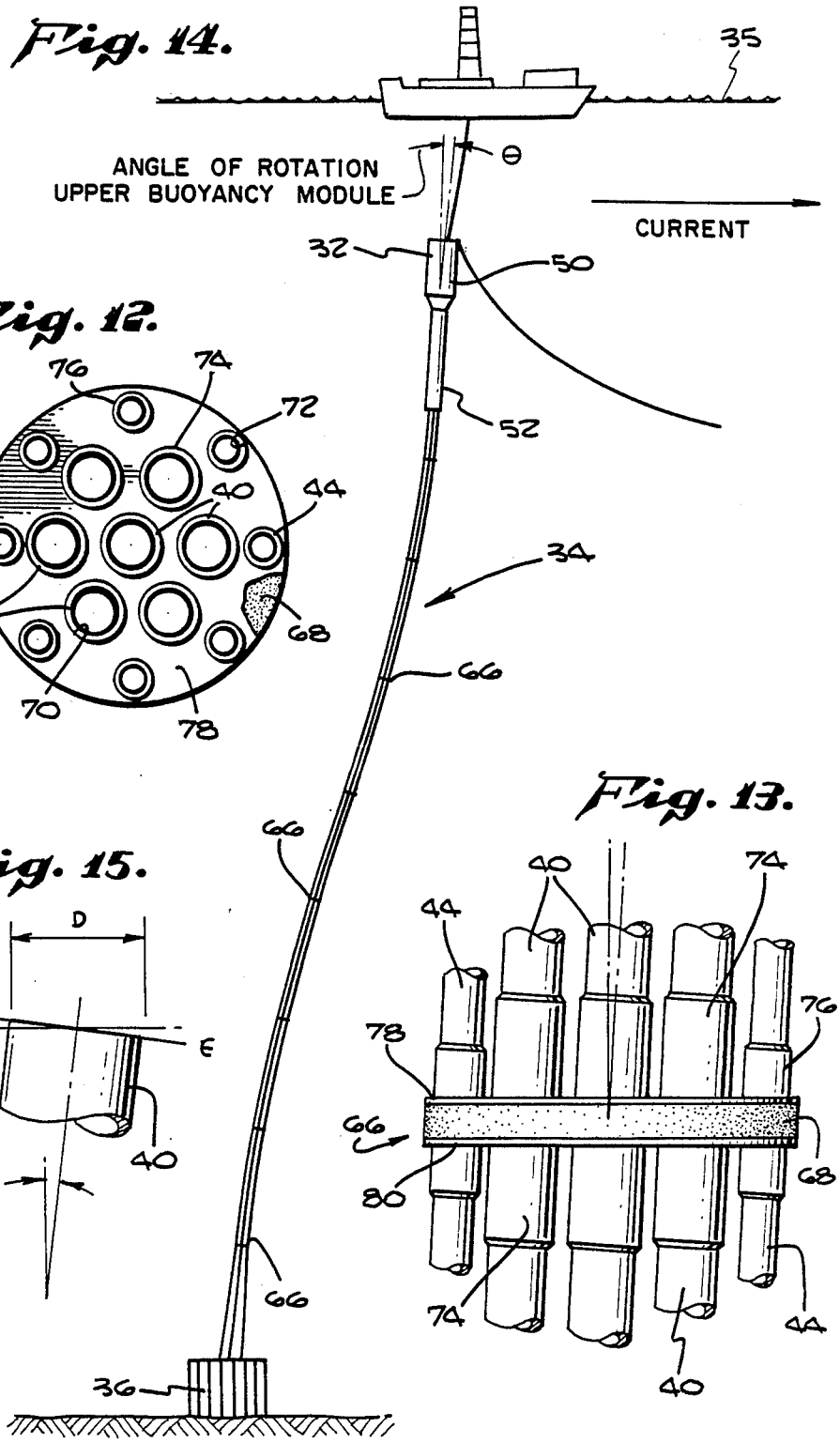
Fig. 12.
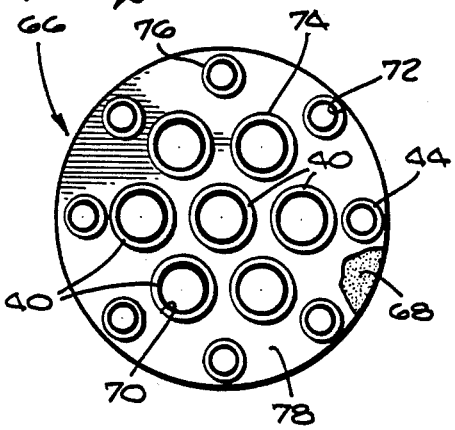
Fig. 13.
Fig. 15.
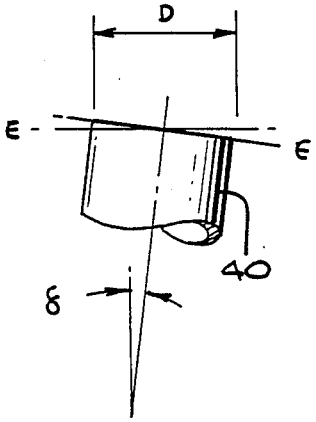

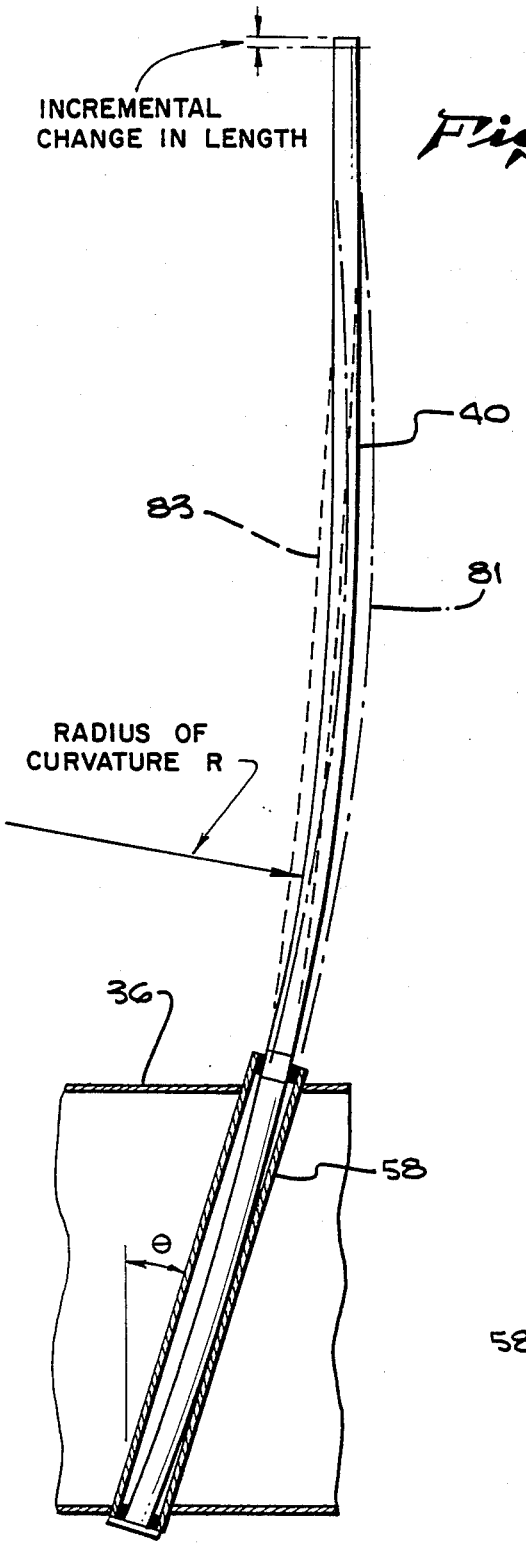
Fig. 17.
Fig. 16.
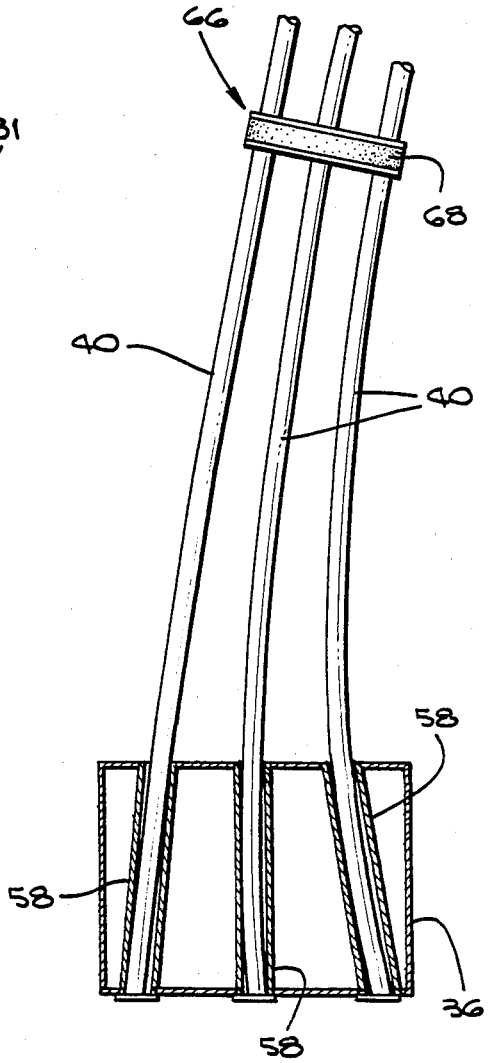

MULTIPLE TENDON COMPLIANT TOWER CONSTRUCTION

BACKGROUND OF INVENTION

This invention relates to offshore tower constructions which include compliant structures; that is, generally speaking, where a platform or well deck above or below the surface of the water is connected with a sea floor module or base by compliant members placed under tension and lateral deflection of an upper buoyancy module occurs in response to wave, winds, and currents.

In one prior proposed compliant tower structure, a main structural central column was provided which rose from the sea floor and was attached at its top end below the surface of the water to a main buoy which held the column upright under constant tension. Running parallel to the central column and connected thereto by a series of guide means were a plurality of peripheral conductors for well fluids, each connected at its top end to a peripheral buoy which supported the weight of the peripheral conductor to prevent the conductor from entering a compression mode. Wellheads and Christmas wire connected to the top end of the conductors which were used to control the well fluid flow from the sea floor. Fluid is then transmitted to plurality of flexible risers which were attached to the top of the main buoy which was located a distance below the surface of the water, the flexible risers extending to a surface vessel. The central column and the peripheral conductors running parallel thereto and connected by guide means were substantially compliant throughout the length of the conductors and column.

Another prior proposed compliant tower included a truss type construction in which legs of the truss were connected to the sea floor and in which the upper portion of the truss enclosed buoyant tanks. When the truss type tower is subjected to flexing due to ocean current movements, the horizontal and diagonal members of the truss are subjected to high stress concentrations which may result in fatigue failures under extended use.

SUMMARY OF THE INVENTION

This invention relates to a novel multiple tendon compliant buoyant tower construction readily adapted to a submerged tower configuration and a surface piercing tower configuration. The primary feature of the present invention is the provision of an assembly of a plurality of tendons arranged in closely spaced parallel relation and serving to connect, under minimal stress conditions, a base module on the sea floor with an upper buoyancy module located below the surface of the water. The plurality of closely assembled tendons are adapted to serve as tension members and their manner of connection to the sea floor and to the buoyancy unit is such that tendon elongation stresses are reduced and the tendency of such a tendon member to collapse under compression is virtually prohibited.

The invention further contemplates a unique compliant tower for offshore well operations in which a relatively compliant tower portion rises upwardly from a base means to which it is connected. The compliant tower portion enters and becomes joined to a relatively stiff upper tower portion which includes a buoyancy means to hold the tower vertical and to tension the compliant tower portion. The compliant tower portion includes a bundle or assembly of parallel closely arranged tendons. Each tendon extends from the bottom of the base to the top of the stiff upper tower portion. At both base and stiff upper tower portion, end portions of a tendon are received within sleeves. At the entrance of a tendon to a sleeve where bending stress may occur, means are provided by this invention to reduce such bending stresses. The stiff upper tower portion provided with an upper buoyancy means and with a stem means depending therefrom provides a selected relationship which reduces the heeling effect at the entrance of the tendon assembly in the sleeves opening at the bottom end of the stress means. Elongation of each tendom from the bottom of the base to the top of the upper stiff tower portion is controlled. The condition of a tendon entering a compression mode during lateral excursions of the compliant tower is also controlled so that severe buckling of a tendon is avoided.

The primary object of the present invention, therefore, is to provide a novel multiple tendon compliant-type buoyant tower construction for use in offshore well operations.

An object of the invention is to provide a novel compliant buoyant tower construction in which a plurality of closely spaced assembled tendons are connected to a base means and to a buoyant tower construction in a novel manner whereby the entire length of each tendon is subjected to minimum elongation for reducing local stresses in the tendon.

An object of the invention is to provide a novel compliant tower construction in which an upper portion of such a tendon assembly functions in an upper stiff tower portion while the lower portion of the tendon assembly is relatively freely compliant.

A further object of the invention is to provide a novel, compliant tower construction in which spacer means are provided at intervals along the length of the assembly of multiple tendons in order to maintain axial alignment of such tendons and to permit limited axial and roll movement of each tendon relative to the other.

A still further object of the present invention is to provide a tower construction as mentioned above in which a buoyancy means is associated with the upper portion of the tendon assembly, such buoyancy means having a bottom stem section of a selected length related to the length of the buoyancy means.

Another object of the invention is to provide a compliant tower construction adapted for operation as a submerged tower or for operation with a platform deck above the water surface.

A still another object of the invention is to provide a novel method for fabrication and assembly of a compliant tower construction.

The invention further contemplates a novel method of connecting ends of a tendon to a base means and to an upper buoyancy module.

Other objects and advantages of the invention will be readily apparent from the following description of the drawings in which exemplary embodiments of the invention are shown.

IN THE DRAWINGS

FIG. 12 is a top view of FIG. 11.

FIG. 13 is an enlarged fragmentary view of the spacer means shown in FIG. 11 illustrating relative movement of the individual tendons.

FIG. 14 is a schematic view of the tower construction under conditions of lateral deflection by various forces.

FIG. 15 is an enlarged schematic view illustrating effect of bending of the tower as shown in FIG. 14.

FIG. 16 is a fragmentary view of bottom tendons under bending forces.

FIG. 17 is a schematic view showing a portion of the base module and tendons illustrating action of the tendons under lateral forces acting on the tower construction of FIG. 1.

DETAILED DESCRIPTION OF THE INVENTION

Figure 1:
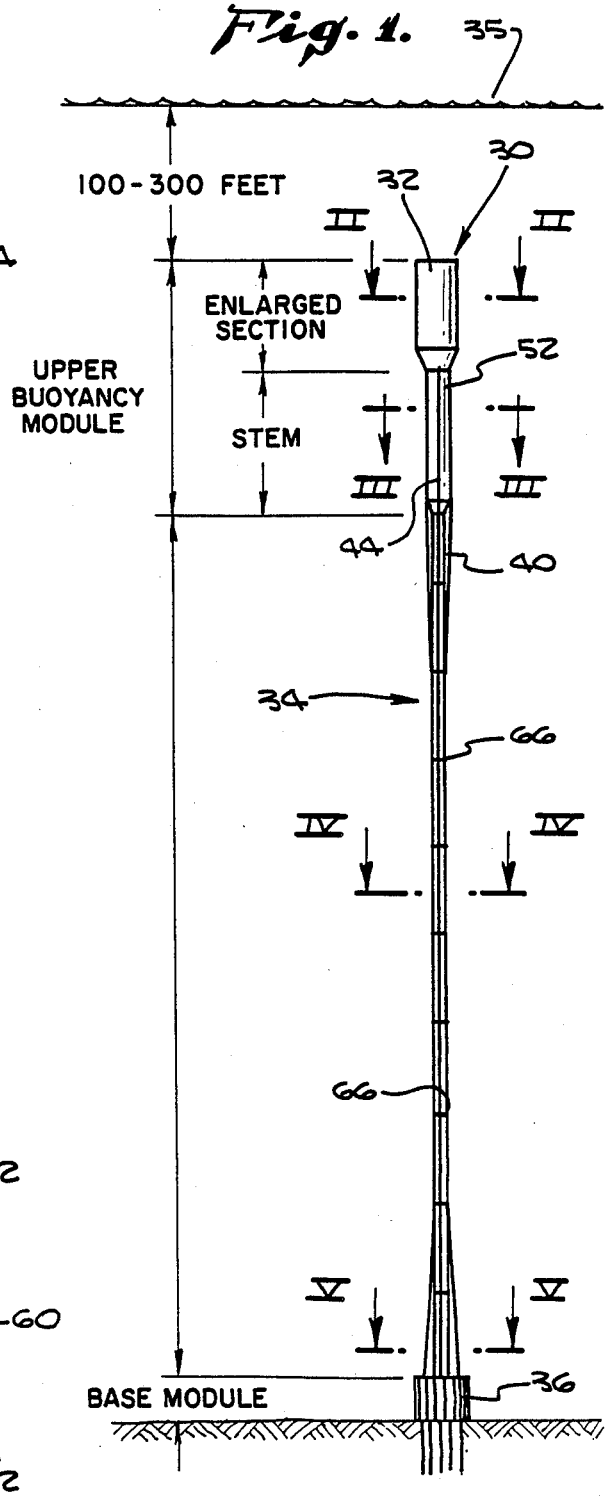
FIG. 1 is an elevational view of a multiple tendon compliant tower construction embodying one example of this invention, the tower construction being below the ocean surface.

In a preferred embodiment of this invention shown in FIG. 1, a compliant buoyant tower construction generally indicated at 30 includes a submerged upper buoyancy module or means 32, (an upper stiff tower portion), located a selected distance such as 100 to 300 feet below the ocean surface 34 and serves to provide an upwardly directed buoyant force which maintains the tower structure in vertical position. Upper buoyancy means 32 is connected to a multiple tendon assembly 34 which at its bottom end is connected to a base module or means 36 on the sea floor and which provides a lower compliant tower portion. In this example of a submerged tower construction, well heads may be located at the top of the tower and connected to surface vessels by suitable means such as flexible lines. In such a vertically disposed tower, forces from waves, sea currents, drilling risers, transfer lines and other forces may cause lateral deflection of the tower, FIG. 14, which will impart stresses to the multiple tendon assembly 34. Before discussing the relief of such stresses by the multiple tendon assembly of this invention, the tower construction will be described in detail.

MULTIPLE TENDON ASSEMBLY

Figure 2:
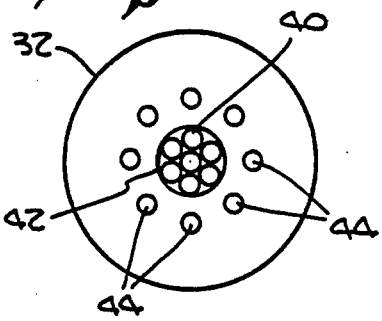
FIG. 2 is a transverse sectional view taken in the plane indicated by line II—II of FIG. 1.
Figure 3:
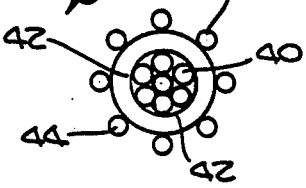
FIG. 3 is a transverse sectional view taken in the plane indicated by line III—III of FIG. 1.
Figure 4:
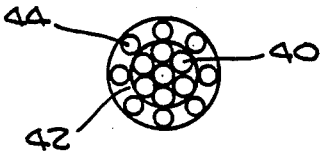
FIG. 4 is a transverse sectional view taken in the plane indicated by line IV—IV of FIG. 1.
Figure 5:
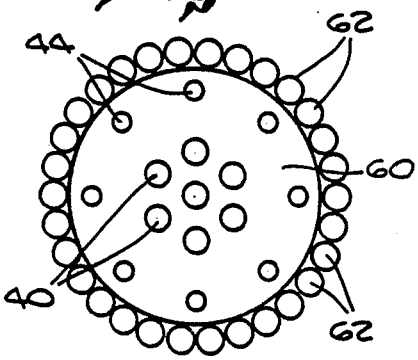
FIG. 5 is a transverse sectional view taken in the plane indicated by line V—V of FIG. 1.

As indicated in the sectional views in FIGS. 2–5 inclusive, the multiple tendon assembly 34 may comprise a plurality of parallel closely spaced tendons 40 arranged along the axis of the assembly 34 and generally confined within a circle 42 as indicated in FIGS. 2, 3 and 4. The circle is not representative of a cylindrical member in these drawings. Each of the tendons 40 may have a diameter of 36 inches. Radially outwardly of the tendons 40 may be provided a plurality of circularly arranged conductors 44 of about 24 inches in diameter which are arranged to conduct various well fluids.

Figure 6:
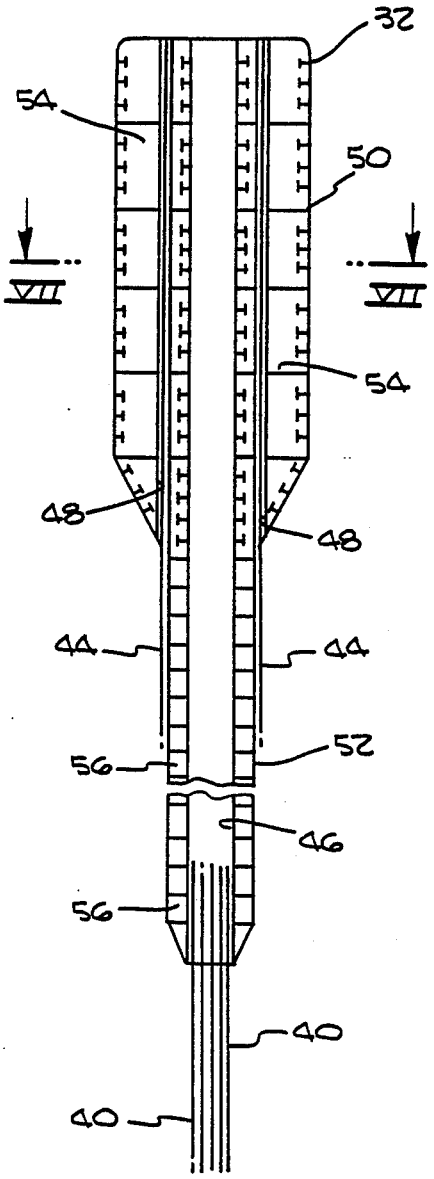
FIG. 6 is an enlarged schematic sectional view of the upper buoyancy module used in the tower construction of FIG. 1.
Figure 8:
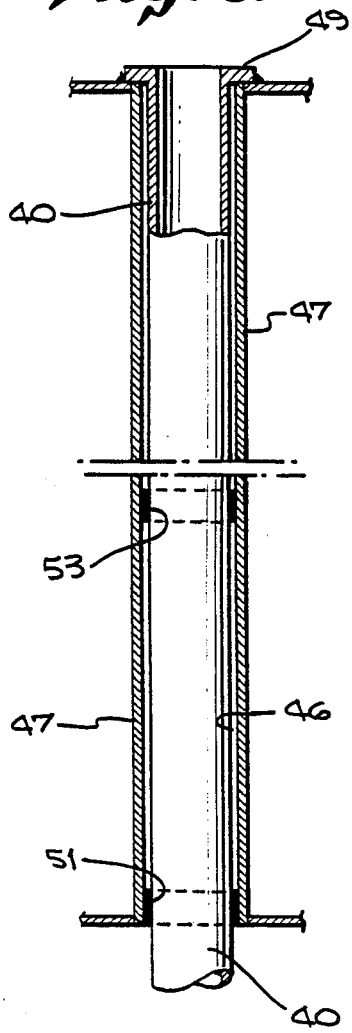
FIG. 8 is a fragmentary, sectional view illustrating the connection of one of the tendons to the top of the upper buoyancy module shown in FIG. 6.
Figure 7:
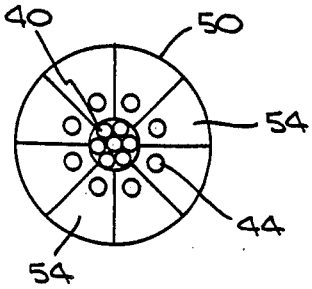
FIG. 7 is a transverse sectional view taken in the plane indicated by line VII—VII of FIG. 6.

The tendons 40 enter the upper buoyancy module 32 through the bottom opening of axial passageway 46, FIG. 6, and extend to the top of buoyancy means 32 and are terminated thereat. As best seen in FIG. 8 passageway 46 is provided by a tube or sleeve 47 which extends from the bottom of the buoyancy module to the top thereof. A sleeve 47 is provided for each tendon 40. At the top of the passageway 46 each tendon 40 is provided with a radially outwardly directed annular flange 49 which may be fixed to the top deck of the module 32 in suitable manner such as by welding. Shims, not shown, may be used prior to welding for adjustment of tension in the several tendons 40 forming the tendon assembly 34. A bottom spacer 51 may be provided at the entrance to passageway 46 and intermediate spacers 53 may be provided at spaced intervals in the passageway. The clearance between the tendon received within the passageway 46 and the sleeve 47 may be sufficient to permit some bending of the upper tendon portion within the passageway.

The conductors 44 may enter a plurality of concentrically arranged passageways 48 radially outwardly of the axial passageway 46 and in the upper enlarged portion 50 of the buoyancy means 32. The tops of conductors 44 may be terminated at the top deck of the buoyancy member 32 in a manner similar to that described for the tendons 40. The conductors 44 are in close spaced relationship to the outer cylindrical surface of the bottom stem 52 of the buoyancy means 32. The buoyancy means 32 includes a plurality of compartments 54 in the enlarged upper buoyancy portion 50 and may include lower buoyancy compartments 56 in the stem 52. Buoyancy compartments may be partitioned in well known manner and include means for introduction of air and water in well known manner and not shown.

Figure 9:
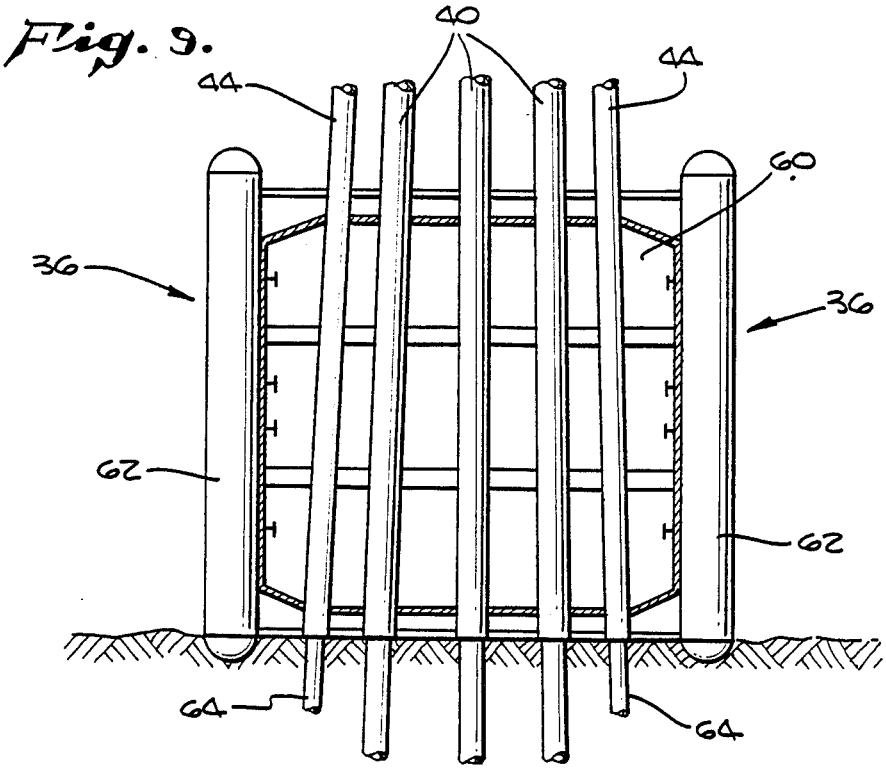
FIG. 9 is an enlarged fragmentary view of the base module used with the tower construction shown in FIG. 1.
Figure 10:
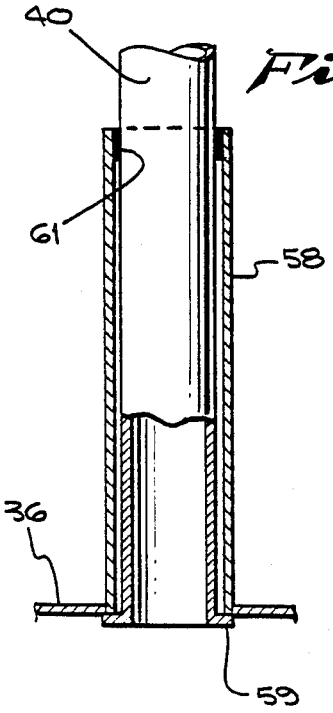
FIG. 10 is an enlarged fragmentary partially sectional view illustrating the connection of the lower end of a tendon to the base means shown in FIG. 9.

With reference to FIG. 9, the tendon assembly 34 at its bottom end is connected to the base means 36. The bottom end of each tendon 40 enters a tube or sleeve 58 provided in the base means 36. The bottom end of each tendon 40 may be provided with a radially outwardly directed flange 59 secured to the bottom wall of the module 36 as by welding. A spacer 61 is provided at the entrance of the tendon 40 into the sleeve of 58. Sufficient clearance is provided between the bottom end portion of the tendon 40 and the interior of the sleeve 58 to permit some bending of the tendon end portion therein as described above for the connection of the top portion of the tendon 40 in the buoyancy module 32.

As shown in FIG. 9, the base means 36 may comprise a receptacle or container means 60 for holding ballast material as required. Around the outer circumference of receptacle 60 are provided a plurality of peripherally arranged vertically disposed buoyancy cylinders 62 which facilitate the installation of the base means as later described. The base means 36 may be secured to the sea floor by pile members 64 which project from certain of the tendons or conductors.

Figure 11:
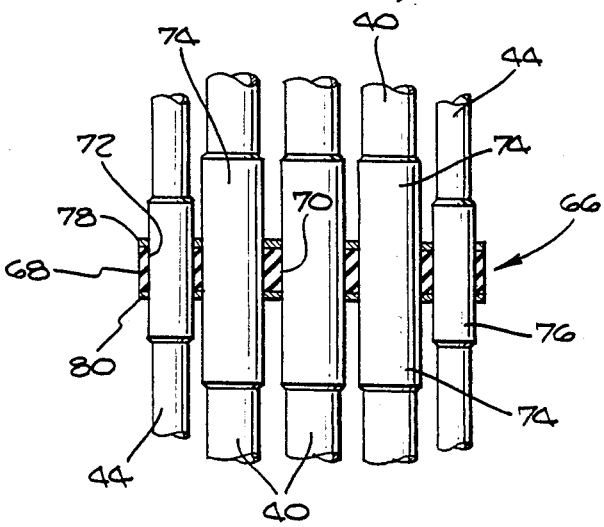
FIG. 11 is an enlarged fragmentary view of a spacer means used with the multiple tendon assembly shown in FIG. 1.

At selected spaced intervals along the length of the tendon assembly 34 may be provided spacer means constructed as shown in FIGS. 11–13 inclusive. Such spacer means 66 may be located at selected intervals such as one hundred feet along tendon assembly 34, the intervals selected depending upon conditions at that particular sea location. Each spacer means may comprise a circular elastomeric member 68 provided with concentrically arranged holes 70 and 72 to receive tendons 40 and conductors 44. Within each hole 70 may be provided a rigid sleeve 74 for guiding a tendon 40 therethrough. Similarly a rigid sleeve 76 may be provided in each hole 72 for guiding a conductor 44 therethrough. The elastomeric member 68 may be confined between and bonded to upper and lower circular steel plates 78 and 80 to form a composite sandwich-like structure of resilient yieldable characteristics. The spacer means 66 provides axial alignment of the tendons and conductors and also permits limited rotation and axial misalignment of each tendon 40 and conductor 44 as indicated in FIG. 13, depending upon stresses imposed on each tendon or conductor by lateral deflection of the tower construction.

The close parallel arrangement of tendons 40 and conductors 44 throughout the length of tendon assembly 34 and with a plurality of longitudinally selectably spaced spacer means 66 holding said tendons and conductors in alignment provides an assembled bundle of tension members having selected compliancy and uniquely adapted for interconnecting a submerged buoyant module to a base means at the sea floor.

UPPER BUOYANCY MEANS

Figure 26:
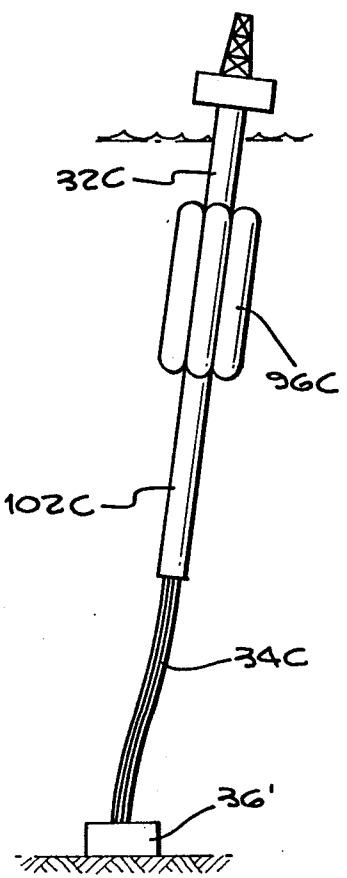

The configuration, shape and proportions of the upper buoyancy module 32 is important in reducing stresses in tendon assembly 34 when the tower is laterally deflected by minimizing rotation of module 32 from the vertical. An overturning moment developed by forces causing deflection of the tower is counteracted by a righting moment developed by the horizontal component of the buoyancy force exerted by the upper buoyancy module 32 and the tension force combined with the gravity force which acts on the bottom of the stem 52 at the bottom opening of passageway 46. If stem 52 is long, the righting moment developed will have sufficient magnitude to keep upper buoyancy module 32 from rotating very much about a point at the bottom of the stem. FIGS. 14, 26 shows upper buoyancy means in displaced position and illustrates this condition.

Analysis of the behavior of the buoyant tower structure when subjected to wind, wave, current and other forces shows that increasing the length of stem 52 serves to decrease the angle of rotation of the upper buoyancy means 32 at the entrance of the tendon assembly 34 into the stem passageway 46. When the length of stem 52 is approximately one and a half times the length of the upper enlarged portion 50 of buoyancy module 32, the angle of rotation of module 32 is significantly reduced. Further increases in the stem length will continue to reduce the angle of rotation, but in diminishing amounts. The proportions of the length of the stem to the upper enlarged buoyancy portion 50 of buoyancy means 32 should be at least one and one half to one and in some instances, a greater proportion depending upon conditions at the location where the buoyant tower is to be utilized.

Development of the righting movement by the buoyancy force acting at the top of upper buoyancy module 32 and by the tension and gravity forces acting at the bottom of the upper buoyancy module, is enhanced by a stem 52 which is relatively stiff with respect to the tendon assembly 34. Such relation between a stiff stem 52 and its length in proportion to the length of the overall tower structure affects dynamic behavior of the tower structure. The fundamental period of the buoyant tower is much longer than the wave period, typically, the first mode of vibration is sixty seconds or greater. Since this is much longer than the a wave period, the tower structure does not respond to the wave energy. However, since the tower construction is essentially a long, slender member, its second or third modes of vibration may fall within the high energy band of the waves. Means for changing the relationship between various modes of vibration can be accomplished by proportioning the length of the stem to the overall length of the tower structure. The longer the stem, the greater will be the separation between the first mode and second mode and greater modes of vibration. Thus, a buoyant tower structure embodying the present invention can be designed to not be very responsive to dynamic wave forces in any of its modes of vibration. The general proportions of the stem as determined by the overturning moment analysis normally result in relatively little dynamic amplification in second and third vibration modes. The length of the stem can be increased to reduce the second and third modes of vibration to tolerable levels.

In a compliant tower structure such as described above, buoyancy of the upper buoyant module is the primary force which keeps the tower vertically erect. As the tower is laterally displaced from the vertical the horizontal components of the buoyancy force tends to restore the tower structure to the vertical position. The stiffness of the upper stiff tower portion will contribute to restoring the tower to the vertical position, but this restoring force is counteracted by a moment developed at the base of the tower. In very deep water, that is over a thousand feet, it is more desirable to minimize the contribution of structural stiffness and rely more on the buoyancy force to maintain the vertical attitude of the tower. As a result, the tower structure may be made lighter and the requirements for the anchor piling will become reduced.

The stiffness of the tower structure is a function of the overall moment of inertia of the column-like tendon assembly. In the case of a single column as in the prior art, the moment of inertia is given by the following formula: $I_{col}=0.0491\ (D^4-d^4)$ where D equals the outside diameter of the column and d equals the inside diameter of the column. In a multi-tendon design, the overall moment of inertia of the bundle of tendons is the sum of the moment of the inertia of the individual tendons. For the same diameter of a single member column a structural column comprising a multitude of small diameter tendons having a bundle diameter of the same dimension will be more compliant than a a single column member. In addition to compliancy, the design of the center column of the buoyant tower must include considerations of displacement, wall thickness of steel construction, and the like.

Considering displacement and wall thickness first, the tower structure should be designed to float on the water. When floated the tower structure can be towed to a well site in horizontal position and upended to vertical position. Additionally, the bundle of tendons must have sufficient cross sectional area to keep axial stress, which results from the upward buoyant force, of module 32 at acceptable levels. If minimum cross-sectional area is achieved by the use of multiple tendons rather than by a single column member, the multiple tendon assembly or bundle will be more compliant than the single column member. With respect to displacement, if the multiple tendons are hollow tubular pipes, the displacement of the bundle of tendons can be sized such that the overall displacement of the tower structure will be positively buoyant and adequate cross-sectional dimensions can be achieved to keep axial stresses tolerable. By incorporating the use of multiple tendons in place of a single central column, the stiffness of the tower structure can be reduced.

The distance between the spacer means 66 is also an important consideration. Axial tension of each tendon will vary depending upon the deflection of the tower. In some cases a tendon on the downstream side of the bundle may be placed under compression while its diametrically opposite tendon on the upstream side of the bundle is placed under tension. The tendons under tension will act to keep the overall tendon bundle straight and will control the overall attitude of spacer means 66. Distance between spacers 66 is selected such that a tendon can undergo a reasonable compressive stress without buckling. Typically such distance would be in the order of one hundred to one hundred fifty times the radius of gyration of the tendon. This criteria may be modified as the distance above the base means increases since tendons will tend to go into compression first near the base of the structure because of their weight.

High bending stresses can develop at the entering of the tendon assembly into the upper buoyancy means 32 at the lower stem 52 thereof and also at base means 36. One means for reducing the bending stress of the tendon assembly at such locations is by gradually increasing the moment of inertia of the tendon assembly as it enters upper buoyancy means 32 and base means 36. In the present example of this invention, each of the tendons may include a tapered portion approaching base module 36 or upper buoyancy module 32. The moment of inertia of each tendon may also be increased by enlarging the diameter of the approaching tendon portion as well as increasing the wall thickness of the tendon. Depending on specific requirements, either or both methods of increasing the moment of inertia may be used.

The end portions of each tendon 40 and each conductor 44 may be connected to the module 32 and base module 36 by passing the tendon end portions through tubes or sleeves 47, 58 respectively having a diameter which allows a limited degree of rotation of the tendon to take place at the point of connection. The use of such a sleeve 47 in the stem 50 of the upper buoyancy module 32 may also be used to control roll of the module.

Another example of connecting the tendon to the upper buoyancy module or the base module includes flaring tendons 40 outwardly from the longitudinal axis of the tendon assembly 34. Such flaring of the tendons reduces cyclic tension differences between upstream and downstream tendons as explained hereafter. When the tower structure is under deflection, the top deck of the upper buoyancy module will assume an angle of heel from its initial horizontal position. The top end of the tendons are attached at the well deck and their bottom ends are attached at the bottom of the base means 36. Tilting of the well deck causes a foreshortening of the downstream tendons and an extension of lengthening of the upstream tendons, FIGS. 14, 15. Assuming that the forces acting on the tower structure are in only one direction and considering only tendons on the upstream and downstream sides of the structure, the incremental change in length "e" of the upstream and downstream tendons is equal to: "e"$=X\theta$ where "e" equals incremental change in length, X equals distance the tendon is from the center line of the structure, and $\theta$ equals angle of buoyancy module from vertical. Exemplary values of the submerged buoyant tower may be considered as: tower length=2,000 feet; X=4 feet; $\theta$=six degrees; and equals 0.4 feet. Thus, the tendon on the downstream side would be foreshortened by a length of 0.4 feet relative to the center line of the tower structure. The upstream tendon would be extended by a length of 0.4 feet. Assuming the tendons were made of steel having a Youngs Modulus E of 30,000,000 psi, the change in axial stress would be: $G=EA/L=6{,}000$ psi. Change in stress can be reduced if a portion of the incremental change in length due to the rotation of the upper buoyancy module 32 were taken up by bending of the tendon.

The curvature of the circumferential tendons may be preset, that is when the tendon is in a relaxed condition, it is curved as shown in FIG. 17 which shows the behavior of the tendons when the upper buoyancy module 32 is displaced laterally and rotated six degrees in a manner similar to the previous example. Curvature of the tendon has increased as at 81 and a portion of the total change in length, that is 0.4 feet, is taken by the increased curvature of the tendon. The condition of the upstream tendon is also shown in FIG. 17. A portion of the extended incremental length of 0.4 feet, is taken up by the straightening up of the curved tendon as at 83. Changes in stresses between tendons can be significantly reduced by incorporating a preset curvature in the tendons in the vicinity of the base in the manner just described.

It will thus be apparent that the use of a multiple tendon assembly as described above provides a tower construction having a high degree of compliancy, positively buoyant, and of adequate cross section to keep axial stresses tolerable as well as providing a simplified means of connecting tendons to the upper buoyancy means 32 and the base means 36.

Figure 19:
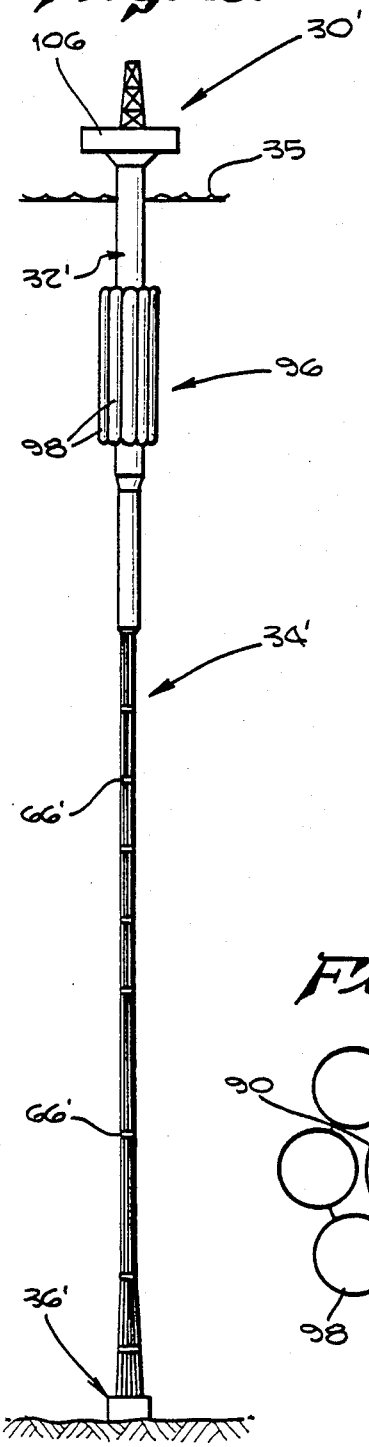
FIG. 19 is an elevational view of a second embodiment of a multiple tendon compliant buoyant tower construction in which the buoyancy module pierces the ocean surface and supports a platform deck.

In the exemplary embodiment of this invention shown in FIGS. 19–27, only the differences in structure will be described and like parts will be given like reference numerals with a prime sign. In FIG. 19 the multiple tendon compliant tower structure generally indicated at 30′ comprises a multiple tendon assembly 34′ having spacer means 66′ connected at their bottom ends to a base module 36′. The multiple tendon assembly 34′ is constructed in the same manner as that described hereinabove for the tendon assembly 34. As noted in FIG. 22, the base module 36' is of slightly different structure but functions in the same manner as the base means 36 of the prior described embodiment. Because of such similarity the tendon assembly 34', spacer means 66' and base means 36' will not be again described in detail.

Figure 20:
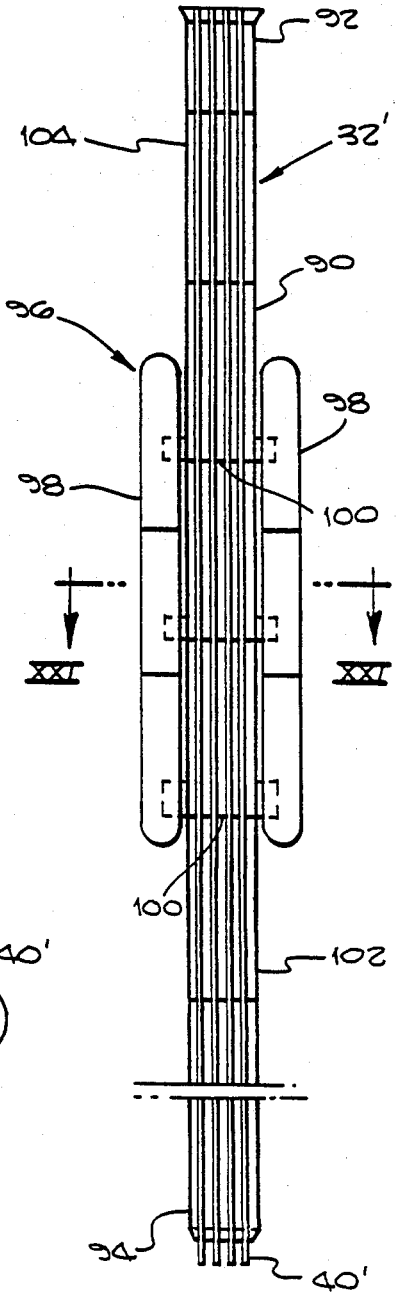
FIG. 20 is an enlarged schematic view of the upper buoyancy module and structure shown in FIG. 18.
Figure 21:
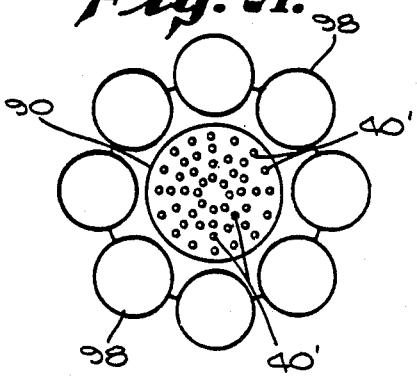
FIG. 21 is a sectional view taken in the plane indicated by line XX—XX of FIG. 20.
Figure 22:
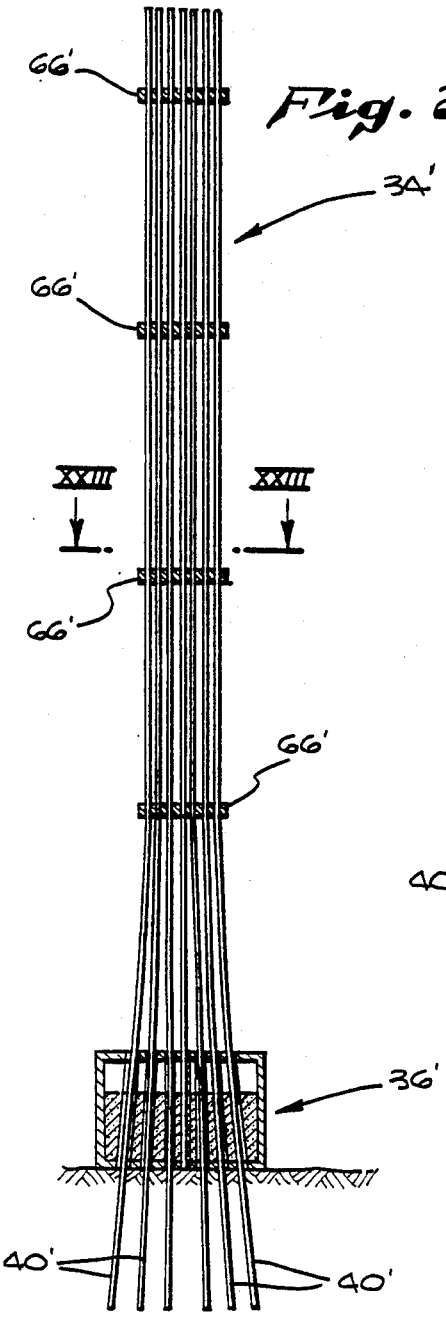
FIG. 22 is an enlarged schematic elevational view partly in section of the lower portion of the tendon assembly and base means shown in FIG. 18.
Figure 23:
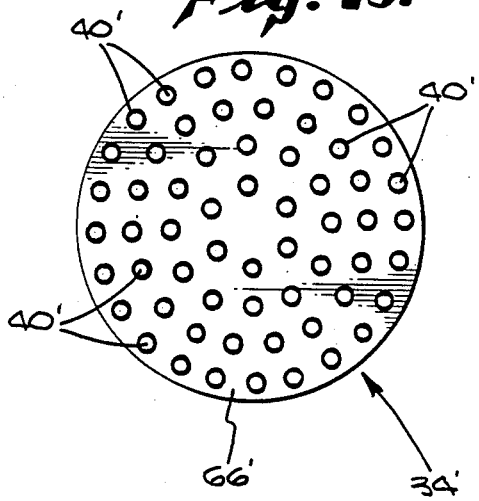
FIG. 23 is a sectional view taken in the plane indicated by line XXIII—XXIII of FIG. 22.

The upper buoyancy module or means generally indicated at 32' is constructed differently than buoyancy module 32. In FIG. 20 upper buoyancy means 32' includes an elongated cylindrical housing or casing 90 having a plurality of tubes or sleeves therein extending from the top 92 of the casing to the bottom 94 of the casing. Each tubing may be considered the equivalent of the tubes or sleeves 47 of the prior embodiment. Tendons 40' extend through the tubing and are connected to the top deck as in the prior embodiment as shown in FIG. 8.

Buoyancy tank means 96 comprising a plurality of elongated cylindrical tanks 98 may be secured to the casing 90 by suitable means generally indicated at 100 at a selected location along the length of casing 90. The criteria for location of the buoyancy means 96 corresponds generally to that of the prior embodiment, that is the enlarged buoyancy portion 50 of the module 32. Below buoyancy means 96 the bottom portion of the casing 90 provides a lower stem 102 which has a selected length to provide the necessary stiffness of the module 32'. The upper stem portion 104 of the casing 90 extends above and pierces the water surface 35 for support of a platform 106 above the water surface.

It will be apparent that upper stem portion 104 and deck 106 subjects buoyant module 32' to additional forces caused by wave action, currents, and winds which tend to laterally deflect the upper buoyancy module 32' relative to the base means 36' in a manner similar to that described above but involving forces of larger magnitude. The stiffness requirements of the upper module 32' may thus be modified and the length of the bottom stem 102 may be required to have a length different than the length of stem 52 described above for the first embodiment.

Figure 25:
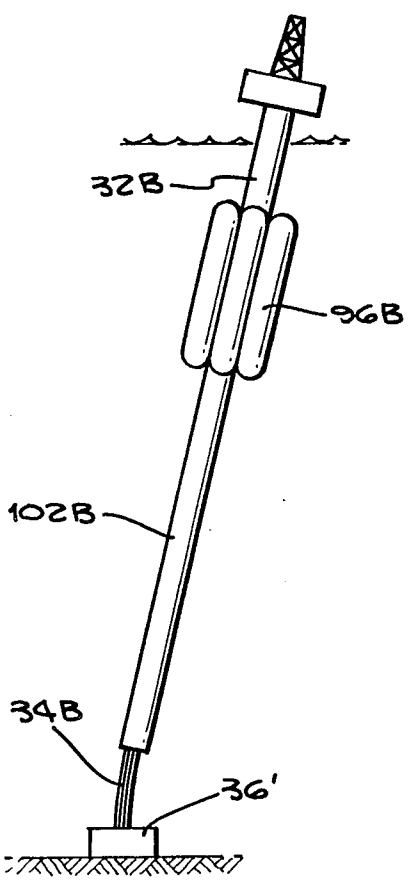
Figure 24:
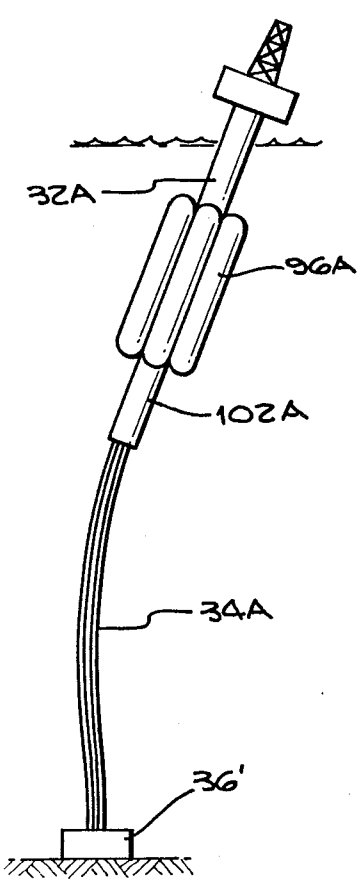

An example of the effect of different stem lengths is illustrated in FIGS. 24, 25 and 26. In FIG. 24 the lower stem 102A is of relatively short length and the lateral deflection of the upper buoyancy module 32' is illustrated as being relatively great with considerable bending of tendon assembly 34A. The angle of heel of the upper buoyancy module 32A is obviously excessive.

In FIG. 25 an upper buoyancy module 32B is illustrated with an extremely long bottom stem 102B which extends to such a depth that the compliancy of the tendon assembly 34B is minimized.

In FIG. 26 a buoyancy module 32C is shown with a bottom stem 102C of a selected exemplary desirable length wherein the relation between the stiffness imparted to the upper portion of the tendon assembly by module 32C to the free portion of the tendon assembly 34C therebelow permits a desired amount of compliancy as illustrated by the general curved shape of the tendon assembly 34C which corresponds generally to the curved configuration of tendon assembly 34 in FIG. 14. The criteria for the amount of stiffness of the upper portion of the tendon assembly within the upper buoyancy module is essentially the same as that described above in the prior embodiment.

Figure 27:
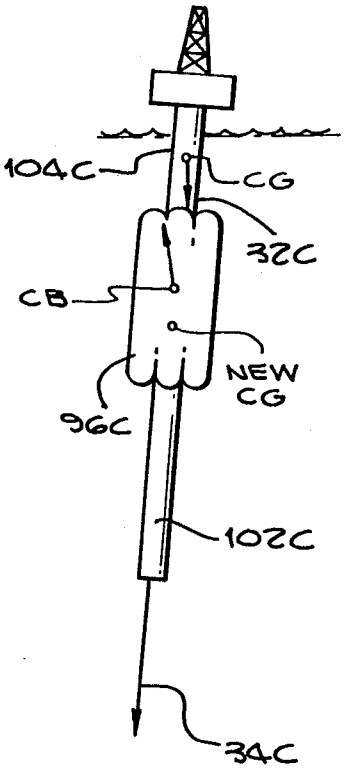
FIGS. 24, 25, 26 and 27 illustrate modifications of the configuration of the upper buoyancy module of the tower construction shown in FIG. 19.

In FIG. 27 buoyancy module 32C is illustrated in an exemplary proportion of the length of bottom stem 102C to the buoyancy means 96C and to upper stem 104C. FIG. 27 also illustrates the effect of tension forces applied to tendon assembly 34C by buoyancy means 96C. The center of gravity of module 32C under conditions of such tension forces acting on the tendon assembly is displaced downwardly to locate the effective center of gravity at a position below the center of buoyancy. FIG. 27 also illustrates a righting force component exerted by the center of buoyancy on the tower construction.

FABRICATION

The multiple tendon assembly 34 lends itself to a simple means of fabrication and assembly. As compared to a single column structure of the prior art, the outside diameter of such a single column may be in the order of eight to ten feet to support the conductors. In a multiple tendon assembly such a single column could be replaced by seven thirty inch diameter tendon members as illustrated in FIG. 2, etc. Smaller diameter pipe is more available, manufactured at lower cost and with superior quality control.

In fabrication of the multiple tendon tower in which the tendon assembly may be assembled in horizontal position, the spacers 66 may be positioned in spaced aligned relation and the upper buoyancy module and base module aligned therewith at either end of the assembly area. Tendon sections are welded together, inserted and fed through the aligned openings in the spacer means and through the sleeves within the upper buoyancy module and the base module. The ends of the tendons may be then welded at the top and bottom ends as previously described. When this structure is assembled in horizontal position, it may be readily launched by sliding the tower construction into the water. In the water the horizontal tower structure can be ballasted to an optimum draft by selectively filling tanks with water and then towing the buoyancy module, base module and tendon assembly interconnecting the modules to the well site.

At the well site the horizontal tower construction may be upended to vertical position and lowered to the sea floor. Since the tower structure is very long, special provisions must be taken to avoid excessive bending stresses and hydrostatic compressive stress as the tower rotates to the vertical position. It is essential during upending to avoid excessive rotating speed or excessive upending speed. By keeping the upending operation slow, the hydrodynamic drag loads on the structure will be minimal and the resulting bending stresses on the column or tendons will be acceptable. Avoiding excessive upending speed is accomplished by providing the lower end of the tower structure, that is at the base module, with only slightly negative buoyancy as it is rotated. It will be noted that the base means 36 includes a plurality of heavy walled cylinders 62 located around the periphery of the base means. The cylinders 62 are designed to withstand hydrostatic pressure when the base is on the sea floor and also have sufficient displacement when filled with air to keep the overall base module only slightly negatively buoyant. In very deep water the cylinders 62 may be pressurized by air prior to upending to reduce compression stresses. This kind of procedure may also be used for the tendons and other portions of the tower structure.

In detail the upending procedure at the well site includes first flooding the ballast tank in the base module which initiates the upending. The tendon assembly is filled with air and the entire column and base is only slightly negatively buoyant. The tower will rotate about a preselected point in the vicinity of the upper enlarged portion of the upper buoyancy module 32. The exact location of this pivot point may be established by partially flooding selected tanks in the stem of the buoyancy module and in the enlarged portion thereof.

When the tower is in vertical position, it is lowered to the sea floor by means of an offshore derrick vessel. The weight portion of the tower supported by the derrick barge is controlled by a combination of selected flooding so that the weight does not exceed the capacity of the derrick. Air cylinders may be provided in the base module, portions of the tendon assembly and compartments in the bottom stem. The compartments flooded are in the lower part of the structure in order to keep the center of buoyancy above the center of gravity and to maintain the tower structure vertical. When the tower is in vertical position and floating, the derrick barge may be connected to the top of the tower. Buoyancy tanks in the upper buoyancy module may then be flooded so that the entire structure is negatively buoyant. The derrick hook which is supporting the tower is then let out until the tower rests on the sea floor.

It will be understood that during lowering air may be injected into the air filled tanks in the upper buoyancy module 32. In the preferred design such air filled tanks are not designed to withstand the full hydrostatic pressure when submerged to operating depth. Therefore, they may withstand the internal pressure differential that exists when the air within the tanks are pressurized to that of the sea water on the outside. By injecting air during lowering of the tower construction and allowing excess air to bleed off the bottom of the tanks of the upper buoyancy module 32, the tanks themselves will not experience excessive differential pressure and the overall weight change in the tower structure may be kept nearly constant. When the tower structure is resting on the bottom it will remain vertical because the center of buoyancy is above the center of gravity and the overall system is negatively buoyant. The derrick barge is then disconnected from the tower structure and pile fastening of the base module to the sea floor may commence.

Figure 18:
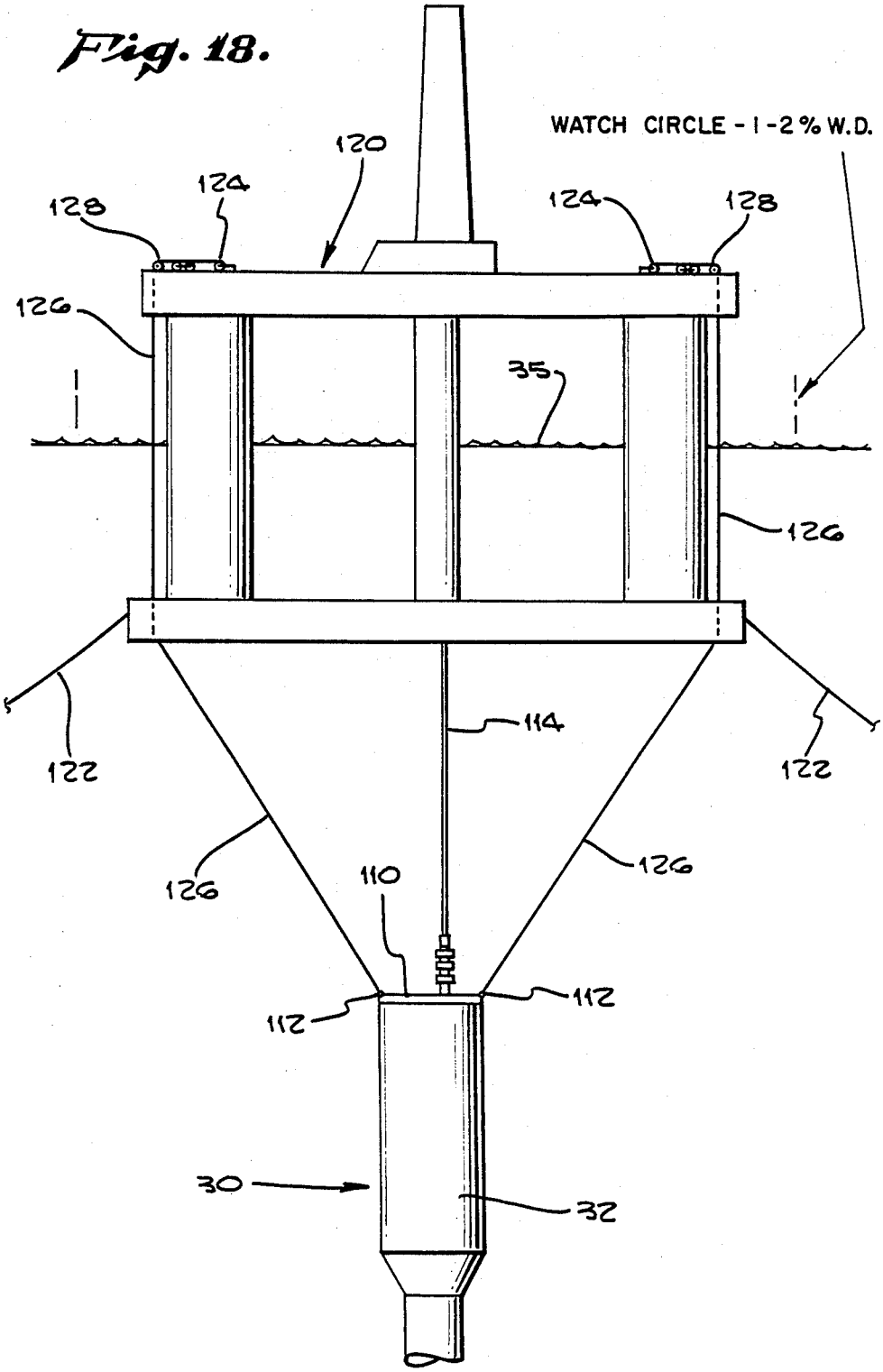
FIG. 18 is a schematic view illustrating a method of locating a drilling rig relative to the tower construction of FIG. 1.

In FIG. 18 a method of positioning the submerged buoyance module 32 relative to the drilling rig is generally illustrated. The drilling rig 120 may be floated over the top of the submerged buoyant tower 30 and anchored by the usual catenary mooring lines 122 which serve to generally position the drilling rig 120 above the tower construction 30. The driling rig may be provided with a plurality of winches 124 on the deck thereof which provide winch lines 106 which may pass over a deck fairlead 128 and downwardly along the sides of the drilling rig to a bottom fairlead (not shown) for attachment of the winch line to the upper deck 110 of the upper buoyancy module 32 as at 112. A plurality of winch lines 126 so attached to the winches 124 and the upper deck 110 of the upper buoyancy module 32 provides lateral adjustment of the drilling rig relative to the buoyant tower construction 30 by varying the tension on the winch lines 126 and the lengths thereof so that a drilling riser 114 may be properly positioned relative to the tower construction.

Various changes and modifications in the two exemplary embodiments of this invention may be made and all such changes and modifications coming within the scope of the appended claims are embraced thereby.

What is claimed is:

1. In an offshore compliant tower construction, the combination of:

an upper buoyancy module;

a rigid stem of selected length fixedly attached to and extending below said upper buoyancy module to minimize rotation of said upper module;

a lower base module;

compliant means interconnecting said upper buoyancy module and said lower base module comprising a composite assembly of a plurality of elongated continuous structural members arranged in parallel independent separate relation and moveable relative to each other;

said structural members having lower end portions with bottom ends fixed to the lower base module and having upper end portions extending into the upper module and with upper ends fixed to said upper module;

and spaced means along the entire length of said structural members between said stem and said base module for holding said structural members in spaced independent moveable relation for individual stressing of said members the length of said compliant means assuming an elongated "S" curve between said stem and said base module under wave force conditions.

2. A construction as claimed in claim 1 wherein said composite assembly of elongated structural members includes a plurality of primary structural members of selected diameter;

and a plurality of secondary structural members having a diameter less than the diameter of said primary structural members.

3. A construction as claimed in claim 1 wherein each of said spaced means includes a tube for slidably receiving each of said structural members during assembly, each tube being secured to said structural member after assembly.

4. An offshore compliant construction comprising in combination:

an upper elongated buoyancy module of selected length and having a depending stem fixed thereto, extending below said module, and terminating at a selected depth of water below said module to effectively increase the righting moment of said upper module;

a lower base module;

and compliant means interconnecting said upper buoyancy module and said lower base module comprising a composite assembly of independent separate primary elongated structural members, independent separate secondary structural members, said primary structural members being arranged about the axis of said composite assembly, said secondary structural members being arranged about said axis of the composite assembly outwardly of the primary structural members;

and spaced means along the length of said composite assembly from said depending stem to said base module for holding said primary structural members and secondary structural members in axial alignment and assembly and in independent relatively moveable relation for permitting independent reaction of each of said structural members throughout the length of said compliant means to wave forces.

5. A construction as claimed in claim 4 wherein said upper buoyancy module and said base module include tubes for receiving upper and lower ends respectively of said primary and secondary structural members;

and means for fixedly securing the top and bottom ends of said structural members to the upper and lower modules adjacent the top and bottom ends of the respective tubes in said upper and lower modules.

6. A construction as claimed in claim 4 wherein said spaced holding means include resilient means for providing limited axial and rotational movement of said structural members at each of said spaced means.

7. An offshore compliant construction, comprising in combination:

a base module including ballast means and base tube means;

an upper stiff rigid buoyancy module having upper tube means and including an upper buoyancy module portion having a selected cross-sectional area, and a lower module stem portion of reduced cross-sectional area extending below said upper portion for a selected length;

plurality of parallel longitudinal hollow tendons and longitudinal hollow conductors arranged in a circular cross-sectional pattern, each of said tendons and each of said conductors being continuous and each extending through one of the said tube means at said base means and secured at its end to said base means and each extending through one of said tube means at said upper buoyancy module and secured at its end to said buoyancy module;

and means to hold said tendons and conductors in parallel relation including a plurality of longitudinally spaced spacer means between said upper buoyancy module and said base module.

8. A construction as claimed in claim 7 wherein said lower module stem portion extends below said upper buoyancy module portion for a length approximately one to one and one-half times the height of the upper buoyancy module portion.

9. A construction as claimed in claim 7 wherein said upper stiff rigid buoyancy module is substantially non-compliant;

and means adjacent the entry of each of said tendons and conductors to the bottom of said upper tube means for reducing stresses in the tendons and conductors at the points of rotation thereof with respect to the lower end of the lower module stem portion.

10. A construction as claimed in claim 7 wherein said spacer means include an elastomeric material providing resilient yieldable means for limited axial and rotational movement of each tendon and each conductor relative to each other.

11. A construction as claimed in claim 7 wherein said ballast means at said base module includes first and second ballast means; one of said ballast means including a fixed ballast of selected weight, and the other ballast means including buoyancy chambers.

12. A construction as claimed in claim 7 wherein said lower buoyancy module stem portion has a selected length to reduce roll of said upper buoyancy module relative to said assembly of tendons and conductors entering the bottom of the lower stem portion.

13. A construction as claimed in claim 7 wherein said upper buoyancy module has a volume for exerting a buoyant force to maintain said tendons and conductors under selected tension for lowering the effective center of gravity of the offshore construction to a selected point below the center of buoyancy.

14. A construction as claimed in claim 7 including means for reducing stresses in each of said tendons and conductors adjacent said base means and including outwardly flaring said tendons and conductors before entering said base module.

15. In the construction as claimed in claim 1 wherein said upper buoyancy module includes an upwardly extending stem means which pierces the sea surface for support of a deck thereon.

16. In an offshore compliant tower construction, the combination of:

an elongated upper buoyancy module having a rigid stem integrally attached thereto and extending therebelow a selected distance to effectively increase the righting moment of the upper buoyancy module;

a lower base module;

a compliant means interconnecting said upper buoyancy module to said lower base module, said compliant means comprising a composite assembly of a plurality of elongated continuous structural members arranged in parallel independent separate relation and moveable relative to each other;

said structural members having lower end portions with bottom ends fixedly connected to the lower base module and having upper end portions extending into the upper module and having upper ends fixedly connected to said upper module;

and means spaced at selected intervals along the entire length of said structural members between said stem of said upper buoyancy module and said base module for holding said structural members in spaced parallel independent moveable relation for individual stressing of said structural members, said fixed connections and said spaced means providing an elongated "S" curve of said compliant means between said stem and said base module under wave force conditions;

said upper buoyancy module including an upper portion adapted to pierce the water surface and to support a platform thereabove.

17. A tower construction as claimed in claim 16 including buoyancy means between said upper portion and rigid stem of the upper buoyancy module.

18. A tower construction as stated in claim 16 wherein said composite assembly of structural members includes a plurality of primary structural members of selected diameter and arranged centrally of said composite assembly;

and a plurality of secondary structural members of a diameter less than the diameter of said primary structural members and arranged outwardly of said primary members;

each of said structural members having lower end portions extending into the lower base module and having a bottom end fixedly connected to lower portions of the lower base module, and an upper end portion extending into the upper module and having an upper end fixedly connected to uppermost portions of said upper module.

19. A construction as claimed in claim 18 including a tube in said base module receiving each lower end portion of each structural member and a tube in said upper module for receiving each upper end portion of each structural member; said tubes having inner diameters larger than the outer diameters of said end portions.

20. In an offshore compliant tower construction, the combination of:

an upper buoyancy module including a depending rigid stem of selected length to minimize rotation of said upper module;

a lower base module;

compliant means interconnecting said upper buoyancy module and said lower base module comprising a composite assembly of a plurality of elongated continuous structural members arranged in parallel independent separate relation and moveable relative to each other;

said structural members having lower end portions with bottom ends fixed to the lower base module and having upper end portions extending into the upper module and with upper ends fixed to said upper module;

spaced means along the entire length of said structural members between said stem and said base module for holding said structural members in spaced independent moveable relation for individual stressing of said members the length of said compliant means assuming an elongated "S" curve between said stem and said base module under wave force conditions;

each of said spaced means including a tube for slidably receiving each of said structural members during assembly, each tube being secured to said structural member after assembly;

said tubes of said spacer means being mounted in a resilient yieldable elastomeric material for limited axial and rotational movement of said structural members relative to each other.

21. In an offshore compliant tower construction, the combination of:

an upper buoyancy module including a depending rigid stem of selected length to minimize rotation of said upper module;

a lower base module;

compliant means interconnecting said upper buoyancy module and said lower base module comprising a composite assembly of a plurality of elongated continuous structural members arranged in parallel independent separate relation and moveable relative to each other;

said structural members having lower end portions with bottom ends fixed to the lower base module and having upper end portions extending into the upper module and with upper ends fixed to said upper module;

spaced means along the entire length of said structural members between said stem and said base module for holding said structural members in spaced independent moveable relation for individual stressing of said members the length of said compliant means assuming an elongated "S" curve between said stem and said base module under wave force conditions;

and a tube on said lower base module for non-rigidly receiving the bottom end portion of each structural member;

and a tube on said upper buoyancy module for receiving the upper end portion of each structural member;

the bottom and top ends of said structural members being fixed to the bottom and top portions of said lower base module and upper module respectively.

22. An offshore compliant construction comprising in combination:

an upper elongated buoyancy module of selected length and having a depending stem terminating at a selected depth of water to effectively increase the righting moment of said upper module a lower base module;

and compliant means interconnecting said upper buoyancy module and said lower base module comprising a composite assembly of independent separate primary elongated structural members, independent separate secondary structural members, said primary structural members being arranged about the axis of said composite assembly, said secondary structural members being arranged about said axis of the composite assembly outwardly of the primary structural members;

spaced means along the length of said composite assembly from said depending stem to said base module for holding said primary structural members and secondary structural members in axial alignment and assembly and in independent relatively moveable relation for permitting independent reaction of each of said structural members throughout the length of said compliant means to wave forces;

said upper buoyancy module including an upper buoyancy chamber means having buoyancy to vertically position said composite assembly, and said stem depends from said upper buoyancy chamber means and has a selected length long enough to minimize rotation of said upper buoyancy module about a horizontal axis of said upper buoyancy module, said stem having a moment of inertia and stiffness to provide uniform transition of stresses from said upper buoyancy module to said composite assembly of said compliant means.

* * * * *